US009815282B2

(12) United States Patent
Chung et al.

(10) Patent No.: US 9,815,282 B2
(45) Date of Patent: Nov. 14, 2017

(54) FLUID EJECTION STRUCTURE

(71) Applicant: HEWLETT-PACKARD DEVELOPMENT COMPANY, L.P., Houston, TX (US)

(72) Inventors: Bradley D. Chung, Corvallis, OR (US); Galen P. Cook, Albany, OR (US); Michael H. Hayes, Corvallis, OR (US); Adam L. Ghozeil, Corvallis, OR (US); Chantelle Elizabeth Domingue, Corvallis, OR (US); Valerie J. Marty, Corvallis, OR (US); Anthony M. Fuller, Corvallis, OR (US); Sterling Chaffins, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/120,676

(22) PCT Filed: Jun. 30, 2014

(86) PCT No.: PCT/US2014/044845
§ 371 (c)(1),
(2) Date: Aug. 22, 2016

(87) PCT Pub. No.: WO2016/003407
PCT Pub. Date: Jan. 7, 2016

(65) Prior Publication Data

US 2017/0106651 A1 Apr. 20, 2017

(51) Int. Cl.

| | |
|---|---|
| ***B41J 2/14*** | (2006.01) |
| ***B41J 2/16*** | (2006.01) |
| ***B41J 29/377*** | (2006.01) |

(52) U.S. Cl.
CPC ..... *B41J 2/14129* (2013.01); *B41J 2/1603* (2013.01); *B41J 2/1628* (2013.01); *B41J 2/1631* (2013.01); *B41J 29/377* (2013.01)

(58) Field of Classification Search
CPC ..... B41J 2/14129; B41J 2/375; B41J 2/3358; B41J 2/04515; B41J 29/377; B41J 2/1631; B41J 2/1603; B41J 2/1628
See application file for complete search history.

(56) References Cited

U.S. PATENT DOCUMENTS 5,945,253 A * 8/1999 Narang ..... B41J 2/14129 430/280.1
5,980,025 A * 11/1999 Burke ..... B41J 2/14129 29/890.1

(Continued)

FOREIGN PATENT DOCUMENTS

| | | |
|---|---|---|
| CN | 1306904 A | 8/2001 |
| CN | 1576006 A | 2/2005 |
| JP | 2003-145767 A | 5/2003 |

OTHER PUBLICATIONS

Wuu, D.S. et al; Characterization of Sputtered Ta—Ru Thin Films for Ink-Jet Heater Applications; Dec. 1999; pp. 180-183 http://www.fis.cinvestav.mx/~smcsyv/supyvac/9/sv918099.pdf.

*Primary Examiner* — Henok Legesse
(74) *Attorney, Agent, or Firm* — HP Inc. Patent Department

(57) ABSTRACT

A fluid ejection structure can include thermal resistors, a substrate, layers on the substrate, wherein said layers can include a region proximate to the resistor that has reduced field oxide.

16 Claims, 4 Drawing Sheets

(56) References Cited

U.S. PATENT DOCUMENTS

| | | | | |
|---|---|---|---|---|
| 6,161,924 | A | 12/2000 | Mitani et al. | |
| 6,504,226 | B1 * | 1/2003 | Bryant | B01J 19/0093 257/510 |
| 8,444,255 | B2 | 5/2013 | Bakker et al. | |
| 2003/0081069 | A1 | 5/2003 | Kim et al. | |
| 2004/0104973 | A1 | 6/2004 | Huang et al. | |
| 2005/0052501 | A1 | 3/2005 | Nakatani et al. | |
| 2005/0136598 | A1 | 6/2005 | Bryant | |
| 2009/0027450 | A1 | 1/2009 | Park et al. | |
| 2012/0091121 | A1 * | 4/2012 | Reitmeier | B41J 2/14129 219/553 |

* cited by examiner

FLUID EJECTION STRUCTURE

BACKGROUND

Fluid ejection structures dispense drops based on input digital data. Typical fluid ejection structures include nozzle arrays in a nozzle plate to dispense fluid. The nozzle arrays may be arranged at a relatively high resolution to be able to dispense at high precision. Some fluid ejection structures are provided with thermal resistors near the nozzles to eject fluids out of the nozzles. To create a firing event with thermal resistors, a current is passed through the resistor, which rapidly heats up and vaporizes a thin layer of fluid near the resistor. The liquid-to-vapor transition creates an expanding bubble near the body of fluid in the firing chamber and ejects a droplet out through the nozzle. Insulating oxide layers are commonly present beneath the resistor in order to direct heat towards the fluid in the firing chamber.

BRIEF DESCRIPTION OF THE DRAWINGS

For the purpose of illustration, certain examples constructed in accordance with this disclosure will now be described with reference to the accompanying drawings in which.

DETAILED DESCRIPTION

Figure 1:
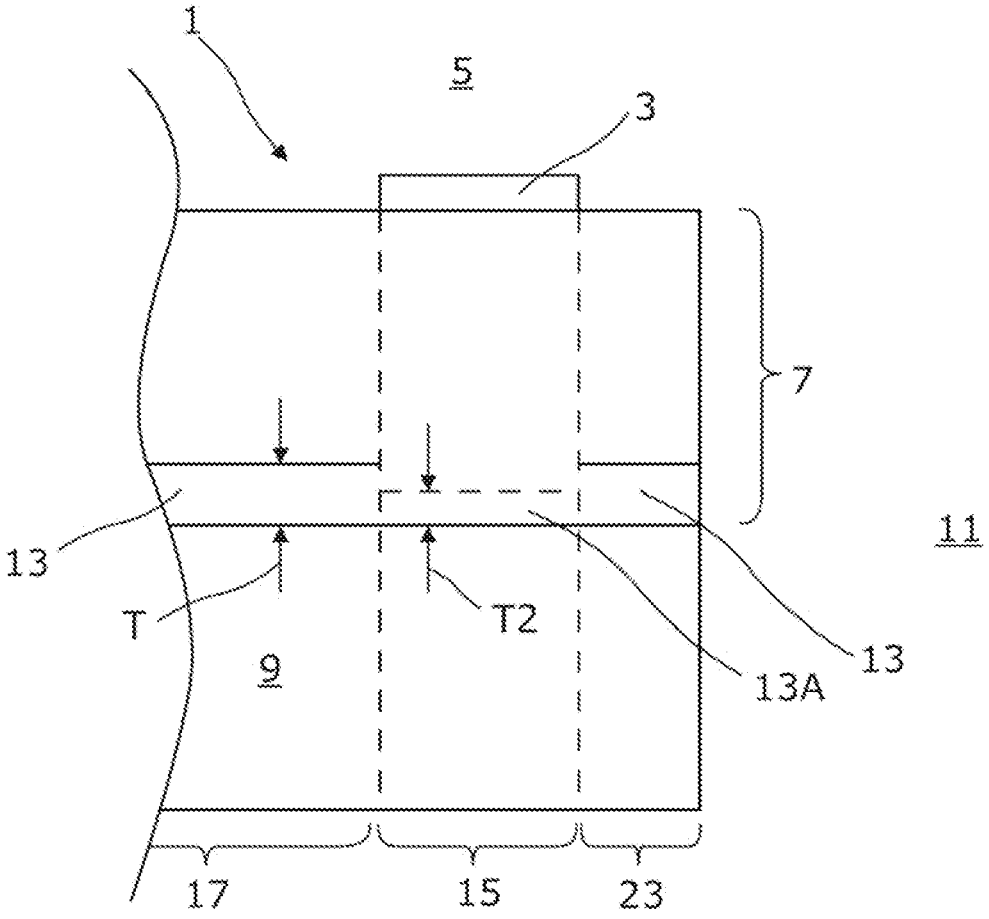
FIG. 1 illustrates a diagram of a cross section of a fluid ejection structure.

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

In this disclosure, fluid ejection structures will be discussed. Typical fluid ejection structures are printheads. Fluid ejection structures of this disclosure may form part of an integrated printhead cartridge or of a fixed or semi-permanent printer printhead. Typical fluids include ink. Further example fluid ejection structures include printheads for three-dimensional printers and high precision digital titration devices. Further example fluids include three-dimensional printing fluids, such as three-dimensional printing agents, including powder binding enhancers and inhibitors, and fluids for digital titration, for example for testing, composing and/or dosing pharmaceutical, bio-medical, scientific or forensic applications. The fluid ejection structure may be part of a finished device or may form an intermediate product. Fluid ejection structures of this disclosure are provided with thermal resistors to eject the drops. In one example the resistors are thermal inkjet (TIJ) resistors. The resistors can be used in any high precision dispensing application such as two-dimensional printing, three-dimensional printing and digital titration.

A fluid ejection structure may include at least one oxide layer disposed over a substrate or conductive circuit. The oxide layers have electrical and thermal insulation properties. An oxide layer near a thermal resistor may insulate the thermal resistor thermally during a fire event, thereby facilitating a rapid and energy efficient firing event. This may result in a low turn-on-energy of the resistors.

When a suitable current is applied to the resistor, the resistor and fluid near the interface with the resistor heat up rapidly, for example applying pulse width ranges of approximately 0.02 to 200 micro-seconds, wherein the amount of time may depend on resistor resistance, resistor size, aspect ratio, fluid type, drop size and resistor pitch. The fluid that is near the resistor is turned to vapor and creates an expanding bubble. The growing vapor bubble forces some of the fluid out of a drop ejection nozzle, resulting in an ejected droplet. After such a firing event, the local pressure caused by the vapor bubble decreases. This event can be referred to as bubble collapse. During the bubble collapse, new fluid residing in a nearby fluid feed slot is drawn back into the firing chamber. After the firing event, if the resistor has not cooled down sufficiently, a sizzle-effect or small scale reboil may occur by the fluid flowing back into the firing chamber onto the hot resistor surface. Where the fluid is ink, it can sometimes occur that solids in the ink form deposits on or near the resistor, which may create thermally inhibiting films that can negatively affect performance of the resistor and nozzle. For example, the resistor or its protective layer, such as tantalum, can be more prone to oxidation if the fluid comes into contact with a hot resistor repetitively. In addition, spending more time at elevated temperatures may have negative effects on the resistors, such as shorter functional resistor lifetimes. Also other chemical and physical properties of the resistor or the fluid can be negatively affected by a slow cool down. Hence, a faster cool down of the resistor may prevent some of the negative effects mentioned above. Although insulating oxide layers near the resistor facilitate a lower turn-on-energy when firing, too much insulation can slow down the cooling of the resistor after firing.

FIG. 1 diagrammatically illustrates a cross section of an example of a part of a fluid ejection structure 1 in a cross sectional front view. The fluid ejection structure 1 includes a thermal resistor 3. The fluid ejection structure 1 of this disclosure is provided with arrays of thermal resistors 3. For example the thermal resistors 3 are arranged in at least one linear array, for example multiple parallel linear arrays. The linear array can have a pitch of at least approximately 300 resistors per inch, at least approximately 590 resistors per inch, for example approximately 600 nozzles per inch.

Each thermal resistor 3 may be disposed in or near a respective firing chamber 5. The thermal resistor 3 is disposed on at least one thin film layer 7. The at least one layer 7 is disposed on a substrate 9. A fluid feed slot 11 is provided next to the resistor 3 and the at least one layer 7. The fluid feed slot 11 is to feed fluid to the firing chamber 5.

The at least one layer 7 includes at least one oxide layer. The at least one oxide layer may include a field oxide layer 13. The at least one layer 7 can be divided in two regions 15, 17. A region 15 of the at least one layer 7 that is between the resistor 3 and the substrate 9 is herein referred to as heat sink region 15. A region next to the heat sink region 15 is herein referred to as neighboring region 17. As will be explained in this disclosure, enhanced heat sinking by the layers 7 may occur in the heat sink region 15. Heat sinking may also occur outside the heat sink region 15 albeit to a lesser extent. In an operational state the fluid ejection structure 1 ejects drops in a downward direction, so that the heat sink region 15 extends on top of the resistor 3. In FIG. 1 the heat sink region 15 extends directly under the resistor 3. For example the fluid ejection structure of FIG. 1 is in a manufacturing or transport orientation which may serve for the purpose of illustration. The heat sink region 15 may be defined as the layer region that defines a shortest distance between the resistor 3 and the substrate 9, which can be illustrated by projecting the thermal resistor 3 onto the layers 7 straight onto the substrate 9 as indicated by dotted lines. A neighboring layer region 17 is located next to the heat sink region 15. In the illustrated example the neighboring layer region 17 is disposed on the side of the heat sink region 15 that is opposite to the fluid feed slot 11. On the other side of the heat sink region 15, a slot region 23 of the layers 7 is disposed. The slot region 23 borders at the fluid feed slot 11. Heat sink region 15 may be centrally located under/over the resistor and may have fewer oxide insulation layers present or less total oxide thickness than the neighboring region 17 and the slot region 23.

In the illustrated cross section, a field oxide layer 13, 13A is disposed over the substrate 9. A field oxide layer 13 having a first thickness T is disposed over the substrate 9 in the neighboring layer regions 17, In the heat sink region 15 the field oxide is reduced with respect to the neighboring regions. In one example, the heat sink region 15 a field oxide field 13A is present that has a reduced thickness T2. In another example the heat sink region 15 is free of field oxide. In this disclosure "reduced field oxide" refers to the feature of any field oxide in the heat sink region 15 being less than the neighboring region, having a thickness T2 of between approximately 0% and 80%, 0% and 70%, 0% and 60%. 0% and 50%, 0% and 40%, 0% and 30%, or 0% and 20% or the neighboring thickness T. When the reduced field oxide is 0% of the neighboring thickness, the heat sink region 15 is free of field oxide. In other examples the field oxide 13A is reduced to between 20% and 80% of the neighboring thickness T. The example of the reduced but not completely omitted field oxide field 13A is indicated by a dotted line.

For example, a strip-shaped rectangular-shaped or circular-shaped field of field oxide is reduced using appropriate silicon processing techniques that may include etching after applying corresponding strip-shaped, rectangular-shaped or circular-shaped masks. In one example a Silicon nitride (SiN) film is deposited, photo patterned and etched, and then field oxide is grown where the SiN film is not present. For example the SiN film is present in the heat sink region 15. Then the SiN is etched and the field oxide remains in the neighboring layer regions 17. In another example the field oxide is grown across the heat sink region 15 and the neighboring and slot regions 17, 23 but is etched afterwards to a thinner layer 13A, in the heat sink region 15 and in the slot region 23.

In the drawing the field oxide layer 13 having the first thickness T terminates at the edge of the heat sink region 15. In other examples the field oxide layer 13 may terminate just outside of the heat sink region 15 or just within the heat sink region 15, as long as at least a part of the substrate 9 is free from the field oxide layer 13 in the heat sink region 15. Field oxide 13 is also disposed over the substrate 9 in the slot region 23. In the drawing, the field oxide 13 in the slot region 23 terminates along the fluid feed slot 11. The feed slot 11 may have been etched through the layers 7, after the layers 7 have been disposed on the substrate 9. An average thickness of summed oxide layers in the heat sink region 15 may be thinner than an average thickness of summed oxide layers in the neighboring layer region 17 and the slot region 23.

It was found that some of the oxide near the resistor 3 can be removed or omitted in the heat sink region 15 to allow the resistor to cool down relatively rapidly before fluid is drawn into the firing chamber 5, while maintaining a sufficient insulation during the firing event, i.e. substantially without affecting the turn-on energy. Field oxide 13, besides being an electrical insulator, has relatively high thermal insulation properties. By reducing a field oxide thickness in the heat sink region, heat can escape to the substrate 9 more rapidly. Through enhanced heat sinking, negative effects of a slow resistor cool down, may be inhibited. In different examples, reducing field oxide near the resistor 3 may improve resistor life, resistor reliability and nozzle health substantially without affecting a turn-on energy of the resistor 3. In a further example, because the resistor 3 cools down more rapidly, a relatively broad range of fluids can be ejected by the fluid ejection structure 1.

Figure 2:
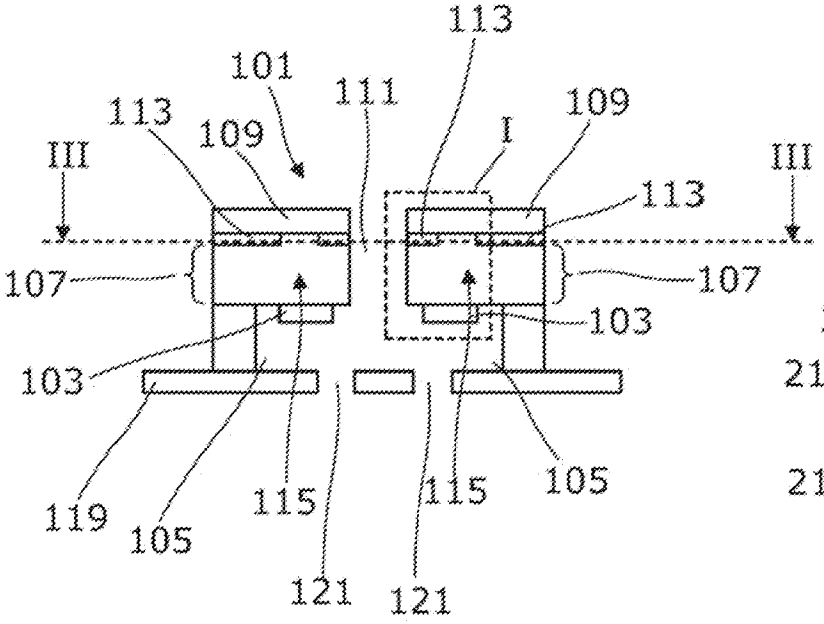
FIG. 2 illustrates a diagram of a cross section of another example of a fluid ejection structure.

FIG. 2 diagrammatically illustrates another example of a fluid ejection structure 101 in another cross section. For example a portion I of FIG. 2 corresponds to the diagram of FIG. 1. In an example, the fluid ejection structure 101 of FIG. 2 forms part of a printhead. The fluid ejection structure 101 includes a fluid feed slot 111, firing chambers 105 and nozzles 121 in a nozzle plate 119. The fluid feed slot 111 opens into two firing chambers 105 that open into nozzles 121. Thermal resistors 103 are provided in each of the firing chambers 105 to eject the fluid out of the nozzles 121. Additional layers, such as silicon-carbide, silicon-nitride and/or tantalum, may cover each resistor 103 to provide protection from chemical and physical attack and electrical isolation during manufacturing and from the ink and firing events.

The resistor 103 is supported by a respective layer stack 107 on a substrate 109. The fluid feed slot 111 runs through the layer stack 107 and the substrate 109. The layer stack 107 includes a field oxide layer 113. As illustrated, the field oxide in a layer region proximate to the resistor 103 is reduced, as compared to non-reduced field oxide 113 in a neighboring layer region. In the illustrated example the field oxide proximate to the resistor 103 is reduced to zero. In another example (not shown), some field oxide is present near the resistor 103, having a reduced thickness with respect to the thickness of the field oxide layers 113 in the neighboring layer regions.

Figure 3:
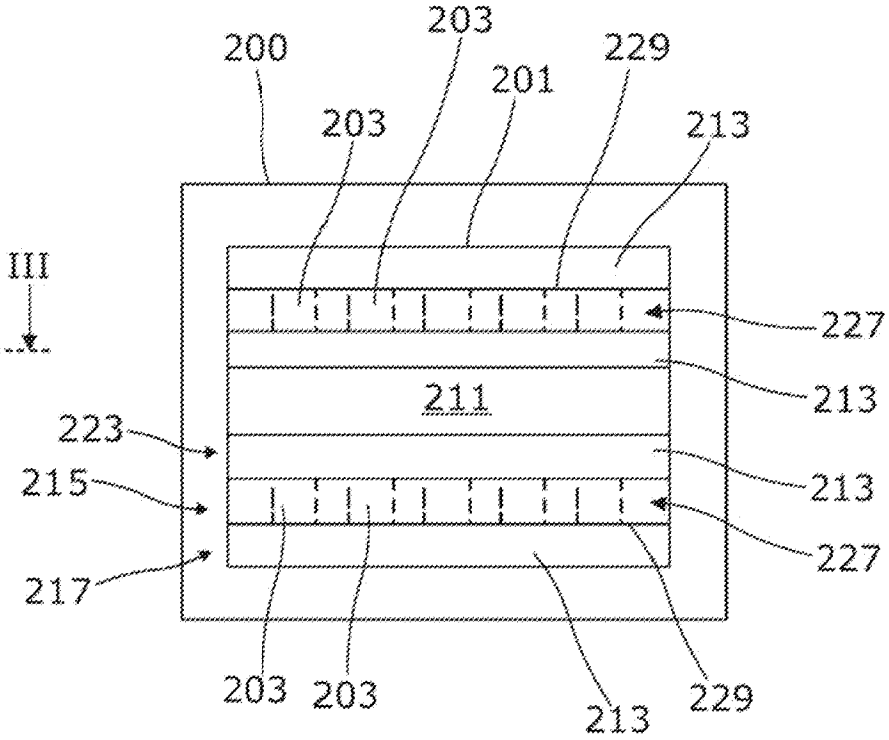
FIG. 3 illustrates a diagram of a cross section of another example of a fluid ejection structure.

FIG. 3 illustrates a diagram of an integrated printhead cartridge 200 including a fluid ejection structure 201. The cartridge 200 may further comprise a fluid reservoir to supply fluid to a fluid feed slot 211. The fluid ejection structure 201 of FIG. 3 may correspond to a cross section III-III of the fluid ejection structure 101 of FIG. 2. The fluid ejection structure 201 includes linear arrays 227 of thermal resistors 203, each thermal resistor 203 disposed near at least one respective nozzle. Because the thermal resistors 203 are not directly exposed in this cross section, the thermal resistors 203 are indicated in dotted lines. In the illustrated example two parallel linear arrays 227 of linear resistors 203 are provided along a single fluid feed slot 211. The nozzles, also not visible in this cross-section, are arranged in corresponding linear arrays. For example multiple fluid feed slots 211 and a double amount of parallel resistor arrays 227 can be provided. For example multiple color reservoirs are provided in one integrated printhead cartridge wherein each color reservoir fluidically connects to at least one fluid feed slot 211.

In one example, the thermal resistor and/or nozzle array has a pitch of at least approximately 300 resistors 203 and/or nozzles per inch. In another example, the thermal resistor and/or nozzle array can have a pitch of at least approximately 590 resistors 203 and/or nozzles per inch, for example at least approximately 600 resistors 203 and/or nozzles per inch, for example approximately 600 resistors 203 and/or nozzles per inch. In again other examples the pitch can be up to approximately 2400 resistors 203 and/or nozzles per inch.

A fluid feed slot 211 is disposed between and parallel to the resistor arrays 227. The fluid feed slot 211 is to receive fluid from the reservoir. The field oxide layer 213 extends on both sides of the fluid feed slot 211, terminating at the fluid feed slot 211. The fluid feed slot 211 may have been etched through said layers after deposition thereof. Field oxide 213 has been reduced in heat sink regions 215 proximate to each resistor array 227, between the resistors 203 and the substrate. The field oxide 213 extends on both sides of the resistors 203, for example in a slot region 223 along the fluid feed slot 211 and in a neighboring region 217 at the opposite side of the heat sink region 215.

In the illustrated example continuous reduced field oxide strips 229 span the resistor arrays 227, extending through each heat sink region 215 of each resistor 203. Each reduced field oxide strip 229 may be free of field oxide or may have less field oxide as compared to a neighboring layer region with non-reduced field oxide. At both sides of the fluid feed slot 211 a reduced field oxide strip 229 extends parallel to the fluid feed slot 211. In one example the field oxide is patterned by first depositing and patterning a Silicon-Nitride (SiN) film so that the SiN spans the resistor array 227. Field oxide is then grown where the SiN is not present and the SiN is etched away. Hence, rectangular reduced field oxide strips 229 may be defined to allow for better heat sinking.

Figure 4:
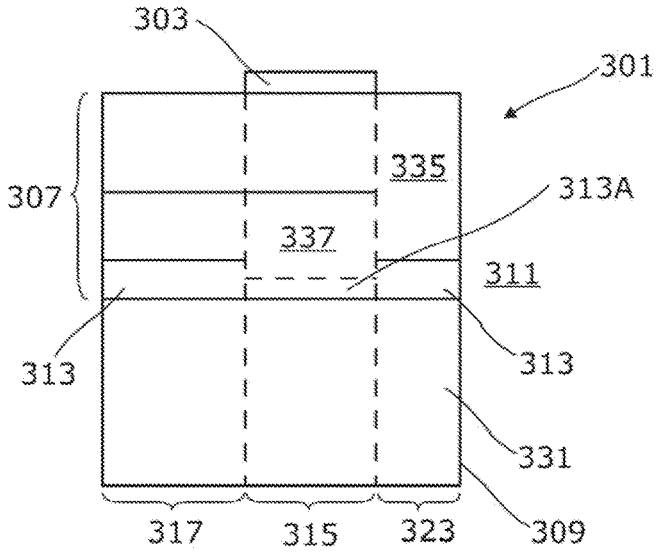
FIG. 4 illustrates a diagram of a cross section of another example of a fluid ejection structure.

FIG. 4 illustrates a diagram of another example of a cross section of a fluid ejection structure 301. The fluid ejection structure 301 includes a thermal resistor 303 disposed over a layer stack 307 that in turn is disposed over a substrate 309. In the illustrated cross sectional portion, the layer stack 307 and the substrate 309 terminate in a fluid feed slot 311 that has been etched through the layer stack 307 after deposition of the layer stack 307. The layer stack 307 includes a heat sink region 315 proximate to the resistor 303, that is defined by projecting the resistor 303 over the layer stack 307 straight onto the substrate 307, as indicated by dotted lines in FIG. 4. A slot region 323 extends at one side of the heat sink region 315 between the heat sink region 315 and the fluid feed slot 311, and a neighboring layer region 317 extends on an opposite side of the heat sink region 315.

The layer stack 307 includes at least one oxide layer 335 at least one layer's distance from the substrate 309. In an example, the oxide layer 335 is not a field oxide layer 313. The oxide layer 335 extends through the neighboring, proximate and slot regions 317, 315, 323, respectively, and terminates at the fluid feed slot 311. The fluid feed slot 311 has been etched through the layers 307 and thereby defines the termination points of the field oxide layer 313 and oxide layer 335. The oxide layer 335 electrically and thermally insulates the resistor 303. The layer stack 307 includes a conductive layer 337. The oxide layer 335 is disposed over the conductive layer 337. The conductive layer 337 includes a metal component or may substantially consist of metal components. The conductive layer 337 extends through the neighboring layer region 317 and at least partly in the heat sink region 315. In an example, it spans the entire heat sink region 315. The conductive layer 337 may be part of a power routing circuit. The conductive layer 337 may have thermal conductive properties that make it suitable as a heat sinking material. The conductive layer 337 may function as a heat sink for the resistor 303 to cool down after a firing event.

Field oxide 313, 313A is disposed over the substrate 309. At least a part of the field oxide 313 has been omitted or removed from the substrate 309 in the heat sink region 315. In one example, the substrate 309 is free of field oxide in the heat sink region 315. In another example a reduced field oxide field 313A, that has a reduced field oxide thickness with respect to the neighboring region 317, is provided in the heat sink region 315, as indicated by dotted lines. By locally removing the field oxide 313 heat can escape through the conductive layer 337 and the substrate 309, after firing, while the oxide layer 335 provides for a sufficient insulation for the duration of the pulse/firing event.

Figure 5:
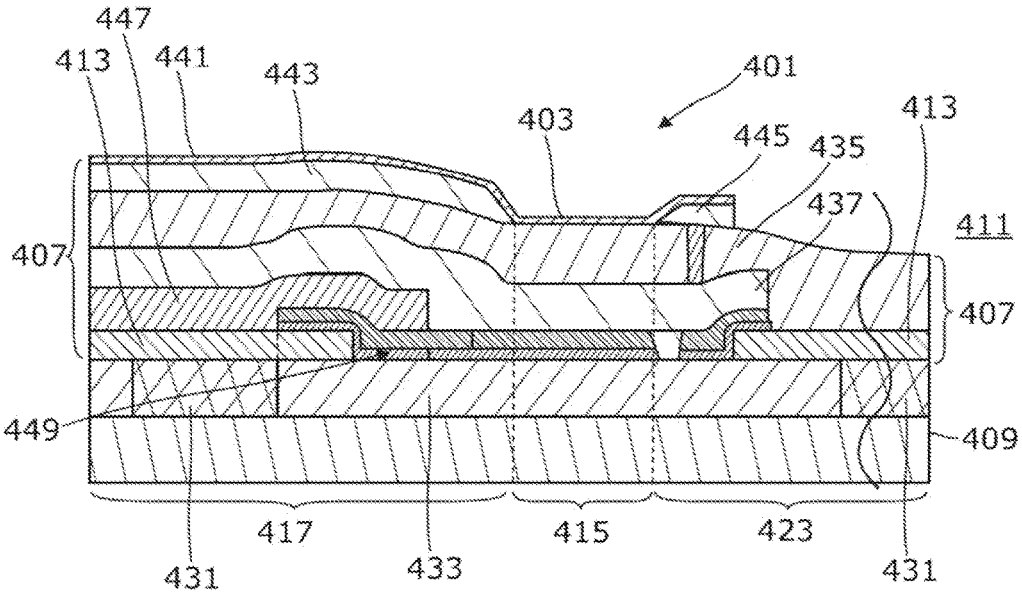
FIG. 5 illustrates a cross sectional view of yet another example of a fluid ejection structure.

FIG. 5 illustrates a cross section of an example fluid ejection structure 401. The fluid ejection structure 401 includes a substrate 409 and a layer stack 407 over the substrate 409. A thermal resistor material layer 441 is disposed on top of the layer stack 407. In one example, the thermal resistor material layer 441 includes Tungsten-Silicon-Nitride (WSiN). An active portion 403 of the thermal resistor material layer 441 will henceforth be referred to as resistor 403. A heat sink region 415 between the resistor 403 and the substrate 409 can be defined by projecting the resistor 403 onto the substrate 409, for example at an approximately straight angle. A neighboring layer region 417 extends next to the heat sink region 415, at the opposite side of a fluid feed slot 411. A slot region 423 covers a layer stack region between the heat sink region 415 and the fluid feed slot 411.

The thermal resistor material layer 441 is disposed over a first and second conductive layer 443, 445, respectively. The first and second conductive layer 443, 445 are resistor power lines to apply a voltage over the active resistor portion 403 of the resistor material layer 441. In the illustration, the first and second conductive layer 443, 445 are the same layer, with part of the layer 443 removed where the resistor 403 is located. In an example, the first and second conductive layers 443, 445 include Aluminum-Copper (AlCu) alloy. The first and second conductive layer 443, 445 extend on opposite sides of the resistor 403. The resistor 403 and the first and second conductive layer 443, 445 are disposed over a first oxide layer 435. The first oxide layer 435 includes Tetraethyl-Orthosilicate (TEOS) and/or high density plasma TEOS. The first oxide layer 435 extends in the neighboring layer region 417, heat sink region 415 and the slot region 423. The first oxide layer 435 terminates at the fluid feed slot 411. The first oxide layer 435 is disposed over a third conductive layer 437. The third conductive layer 437 includes a metal component. In example, the third conductive layer 437 includes Titanium (Ti), Titanium-Nitride (TiN) and AlCu. The third conductive layer 437 can be part of a power routing circuit, for example a power ground or power supply circuit. The third conductive layer 437 extends from the neighboring layer region 417 into the heat sink region 415. In the illustrated example the third conductive layer 437 terminates beyond the heat sink region 415 in the slot region 423, at a distance from the fluid feed slot 411. In the slot region 423, the first oxide layer 435 and the field oxide 413 isolate the third conductive layer 437 from fluid in the fluid feed slot 411. The third conductive layer 437 is disposed over a second oxide layer 447. In an example, the second oxide layer 447 includes TEOS and Borophosphosilicate (BPSG). In the illustrated example, the second oxide layer 447 extends and terminates in the neighboring layer region 417. The heat sink region 415 is free of the second oxide layer 447. The second oxide layer 447 is disposed over a field oxide layer 413. The field oxide layer 413 covers the substrate 409. In this example, the field oxide layer 413 extends in the neighboring layer region 417 and in the slot region 423. In this example, the field oxide layer 413 terminates outside of the heat sink region 415, in the neighboring and the slot regions 417, 423, respectively. The substrate 409 is free from field oxide in the heat sink region 415. A gate layer 449 is disposed over the substrate 409 in the heat sink region 415, spanning the heat sink region 415. The gate layer 449 may comprise polysilicon and gate oxide. The polysilicon may perform as a protective etch stop while the gate oxide provides for electrical insulation. The gate layer 449 terminates in the neighboring layer region 417 and in the slot region 423. The gate layer 449 is partly disposed over the field oxide layer 413, in the neighboring layer region 417, near one edge and partly over the field oxide layer 413, in the slot region 423, near an opposite edge. The third conductive layer 437 is disposed over the gate layer 449 in part of the neighboring layer region 417, the heat sink region 415 and the slot region 423. The second oxide layer 447 and the gate layer 449 may insulate the third conductive layer 437 from the field oxide layer 413 and the substrate 409.

The substrate 409 can include doped n-well regions 433 with increased electrical resistance that provides additional electrical isolation between the conductive substrate 409 and third conductive layer 437. Such n-well region 433 can be electrically connected to a ground source or electrically floating. One doped n-well region 433 spans the heat sink region 415. For example, the doped n-well region 433 extends from the neighboring layer region 417 into the heat sink region 415 and into the slot region 423, terminating at one edge in the neighboring layer region 415 and at an opposite edge in the slot region 423. The doped n-well region 433 spans the entire surface where the gate layer 449 is disposed on the substrate 409, the edges terminating at a respective field oxide layer 413.

P-well regions 431 are provided at both sides of the n-well regions 433. Field oxide 413 can be disposed over the p-well regions 431. For example, the p-well regions 431 extend where a field oxide layer 413 and another oxide layer 435, 447 are stacked over the substrate 409. For example, in the neighboring layer region 417 the p-well region 431 resides where a field oxide layer 413 and a second oxide layer 447 are stacked over the substrate 409. For example, in the slot region 423 the other p-well region 431 resides where a field oxide layer 413 and a first oxide layer 435 are stacked over the substrate 409.

The n-well region 433 electrically isolates the third conductive layer 437 from the p-well regions 431. To further enhance electrical isolation of the third conductive layer 437, the second oxide layer 447 terminates on the gate layer 449 and the gate layer 449 terminates on the field oxide layer 413 and under the second oxide layer 447, in the neighboring layer region 417. At the opposite side, in the slot region 423, the gate layer 449 terminates on the field oxide layer 413 while the n-well region 433 terminates further out into the slot region 423.

The example fluid ejection structure 401 may provide for a suitable firing event-insulation and post-firing-event cool down. The first oxide layer 435 thermally insulates the resistor 403 during the firing event while the removed and reduced second oxide layer 447 and reduced field oxide layer allow heat to be transported to the substrate 409 post-firing. The third conductive layer 437 aids in conducting heat to the substrate 409.

Figure 6:
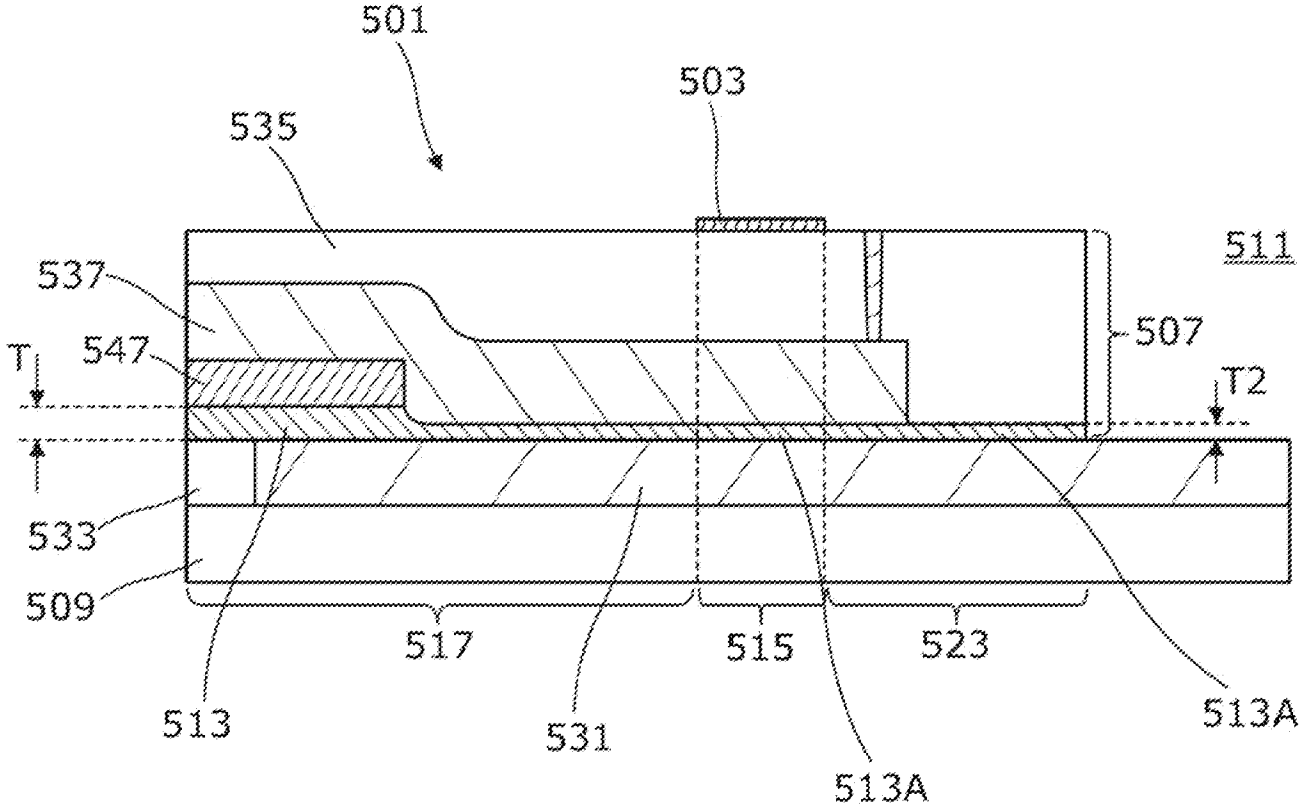
FIG. 6 illustrates a cross sectional view of again another example of a fluid ejection structure.

FIG. 6 illustrates a diagram of a cross section of another example fluid ejection structure 501. The fluid ejection structure 501 includes a substrate 509 and a layer stack 507 over the substrate 509. A thermal resistor 503 is provided on top of the layer stack 507, for example as part of a thermal resistor material layer (not shown) and connected to power lines to apply a voltage over the resistor 503. A heat sink region 515 between the resistor 503 and the substrate 509 can be defined by projecting the resistor 503 onto the substrate 509, for example at an approximately straight angle. A neighboring layer region 517 extends next to the heat sink region 515, at the opposite side of a fluid feed slot 511. A slot region 523 covers a layer stack region between the heat sink region 515 and the fluid feed slot 511.

The resistor 503 is disposed over a first oxide layer 535. The first oxide layer 535 extends in the neighboring layer region 517, heat sink region 515 and the slot region 523. The first oxide layer 535 terminates at the fluid feed slot 511, wherein the fluid feed slot 511 has been etched through the layers 507 after deposition of the layers 507. The first oxide layer 535 is disposed over a conductive layer 537. The conductive layer 537 can be part of a power routing circuit, for example a power ground or power supply circuit. The conductive layer 537 extends from the neighboring layer region 517 into the heat sink region 515. In the illustrated example the conductive layer 537 terminates beyond the heat sink region 515 in the slot region 523, at a distance from the fluid feed slot 511. In the slot region 523, the first oxide layer 535 isolates the conductive layer 537 from fluid in the fluid feed slot 511. The conductive layer 537 is disposed over a second oxide layer 547. In the illustrated example, the second oxide layer 547 extends and terminates in the neighboring layer region 517. The heat sink region 515 is free of the second oxide layer 547. The second oxide layer 547 is disposed over a field oxide layer 513, 513A.

The field oxide layer 513 covers the substrate 509. In this example, the field oxide layer 513 extends in the neighboring layer region 517, the heat sink region 515 and in the slot region 523. In the neighboring layer region 517 the field oxide layer 513 has a first thickness T. In the heat sink region 515 and the slot region 523 the field oxide layer 513A has a thickness T2 that is reduced with respect to the first thickness T. In the illustrated example, the reduced field oxide field 513A extends into the neighboring region 517, terminating outside of the heat sink region 515, at a point where the second oxide layer 547 terminates. In the slot region 523, the reduced field oxide field 513A terminates at the fluid feed slot 511. The reduced field oxide field 513A may have a thickness T2 that is approximately 70% or less, or approximately 60% or less, or approximately 50% or less, or approximately 40% or less than the non-reduced thickness T1. Here, no gate layer or etch stop layer is provided over the substrate in the heat sink region 515. The substrate 509 includes doped p-well regions 533 that overlap the heat sink region 515 and extend into the neighboring layer region 517 and the slot region 523. For example, the p-well region 533 extends along the entire reduced field oxide field 513A and beyond.

In an example, the fluid ejection structure 501 does not have polysilicon as a protective etch stop. A dry etching process may be used to remove a pre-exposed or patterned second oxide layer 547. For example while the second oxide layer 547 is being etched to clear part of the second oxide layer 547, the field oxide is exposed to the same etch process intended to clear the second oxide layer 547, thereby etching and thinning the field oxide that is not protected by any polysilicon. After this final etching, the thickness T2 of the field oxide 513 next to the second oxide layer 547 can be 80% or less, 70% or less, 60% or less, 50% or less, 40% or less, 30% or less, or 20% or less of the original field oxide thickness T. In an example the reduced field oxide field 513A has a thickness T2 of between approximately 20% and approximately 80% of the neighboring thickness T. In an example the reduced field oxide field 513A terminates at approximately the same point as the second oxide layer 547. Hence, the reduced field oxide field 513A extends from the end point of the second oxide layer 547 up to the fluid feed slot 511. The reduced field oxide field 513A is reduced so as to be thick enough to provide for electrical isolation between the conductive layer 537 and the substrate 509. Hence, no n-well doped region 531 is needed under the reduced field oxide field 513A.

The example fluid ejection structure 501 may provide for a suitable firing event-insulation and post-firing-event cool down. The first oxide layer 535 thermally insulates the resistor 503 during the firing event while the reduced second oxide layer 547 and field oxide 513A allow for heat to be transported to the substrate 509 post-firing. The conductive layer 537 and reduced field oxide 513A aid in conducting heat to the substrate 509.

In the different examples that are described in this disclosure oxide layers near the resistor are thick enough to insulate during the duration of a firing event, and thin enough to allow for heat sinking to the substrate to cool the resistor down after firing and prior to fluid refilling a firing chamber after being blown out of the firing chamber. In different examples of this disclosure heat and cool events occur in using pulse width ranges of less than 1 microsecond up to several (tens of) microseconds. In different examples of this disclosure, all layer thicknesses can be in ranges of approximately 10 to approximately 2000 nm. For example a field oxide layer can have a thickness of between approximately 200 and approximately 1000 nm, for example between approximately 400 and approximately 700 nm.

Field oxide may be deposited and reduced by using appropriate integrated circuit (IC) wafer manufacturing techniques such as patterning films that block field oxide growth or photolithography and dry or wet-etching techniques. In different examples, of the reduced field oxide field thickness T2 can be between approximately 0 and 80% of the neighboring thickness T. For example the reduced thickness of the field oxide is 0% when completely omitted (e.g. prevented from growing) or higher than 0%, for example up to 20%, 30%, 40%, 50%, 60%, 70% or 80% when only partly removed. Other layers can be disposed or omitted to provide for robust enough electrical insulation and isolation, or to provide for chemical or physical etch stops during fabrication of the structure. The enhanced thermal performance of the example fluid structures may inhibit, at least to some degree, heat driven issues including chemical or physical degradation of a resistor's tantalum protection layer, and the deposition of contaminants on the resistor. A better and longer performing resistor may be obtained and a wider range of fluids may be ejected using some of the examples of this disclosure.

The invention claimed is:

1. A fluid ejection structure, comprising
a multitude of thermal resistors,
a substrate,
layers on the substrate, comprising
a heat sink region between each resistor and the substrate, and
a neighboring region next to the heat sink region the neighboring region comprising a field oxide layer on the substrate having a first thickness, wherein a reduced field oxide layer in the heat sink region has a thickness of between 0% and 80% of said first thickness,
at least one firing chamber near at least one of the resistors,
a fluid feed slot to the firing chamber, wherein
the neighboring region extends next to the heat sink region opposite from the fluid feed slot, and
a slot region is provided between the heat sink region and the fluid feed slot, the slot region comprising a field oxide layer that covers the substrate and terminates at a fluid feed slot.

2. The fluid ejection structure of claim 1 wherein at least one thermal resistor material layer includes said multitude of thermal resistors, wherein the heat sink region and the neighboring region are composed of layers stacked between the substrate and the thermal resistor material layer.

3. The fluid ejection structure of claim 1 comprising at least one fluid slot and at least one thermal resistor array parallel to said fluid slot wherein the reduced field oxide layer field spans the entire thermal resistor array.

4. The fluid ejection structure of claim 1 wherein
the neighboring region comprises at least one oxide layer other than the field oxide layer in the neighboring region, and
the layers are free of that oxide layer in the heat sink region.

5. The fluid ejection structure of claim 1 wherein an average thickness of summed oxide layers in the heat sink region is thinner than an averaged thickness of summed oxide layers in the neighboring region.

6. The fluid ejection structure of claim 1 comprising a conductive layer that includes a metal component, extending from the neighboring region into the heat sink region.

7. The fluid ejection structure of claim 6 wherein the conductive layer is part of a power routing circuit.

8. The fluid ejection structure of claim 1 wherein the heat sink region is free of field oxide.

9. The fluid ejection structure of claim 8 wherein at least one gate layer is disposed between the substrate and the conductive layer.

10. The fluid ejection structure of claim 8 wherein the substrate includes an n-well region that spans the heat sink region.

11. The fluid ejection structure of claim 1 wherein field oxide of reduced layer thickness is provided in the heat sink region, and no gate layer is disposed in the heat sink region.

12. The fluid ejection structure of claim 11 wherein the substrate includes a p-well region that spans the heat sink region.

13. The fluid ejection structure of claim 1 wherein the neighboring region further comprises
a thermal resistor material layer,
at least two oxide layers other than the field oxide layer, and
a power routing circuit layer; and
the heat sink region further comprises
at least one less oxide layer as compared to the neighboring region,
the power routing circuit layer, and
a gate oxide layer.

14. The fluid ejection structure of claim 1 wherein the thermal resistors are arranged at a pitch of at least 300 per inch.

15. A fluid ejection structure, comprising a multitude of thermal resistors, a substrate, layers on the substrate, comprising a heat sink region proximate to the resistor, between each resistor and the substrate, and a neighboring region next to the heat sink region, the neighboring region comprising field oxide layer on the substrate having a first thickness, wherein a reduced field oxide layer in the heat sink region has a thickness of between 0% and 80% of said first thickness, wherein the neighboring region further comprises a thermal resistor material layer, at least two oxide layers other than the field oxide layer, and a power routing circuit layer; and the heat sink region further comprises at least one less oxide layer as compared to the neighboring region, the power routing circuit layer, and a gate oxide layer.

16. A fluid ejection structure, comprising at least one thermal resistor material layer including a thermal resistor array, a substrate, and at least one oxide layer between a thermal resistor material layer and the substrate, the at least one oxide layer including a reduced field oxide layer field over the substrate a region proximate to the resistor to enhance cooling of the resistor after firing, and a non-reduced field oxide layer over the substrate outside of a region proximate to the resistor, at least one firing chamber near at least one of the resistors, a fluid feed slot to the firing chamber, and a slot region provided between the region proximate to the resistor and the fluid feed slot, the slot region comprising field oxide layer that covers the substrate and terminates at a fluid feed slot.

* * * * *